United States Patent [19]

Scarfe

[11] 4,095,432

[45] Jun. 20, 1978

[54] MINE ROOF SUPPORTS

[75] Inventor: Arthur Scarfe, Wakefield, England

[73] Assignee: Fletcher Sutcliffe Wild Limited, Wakefield, England

[21] Appl. No.: 688,940

[22] Filed: May 21, 1976

[30] Foreign Application Priority Data

May 22, 1975 United Kingdom ..... 22144/75

[51] Int. Cl.[2] ..... E21D 15/44

[52] U.S. Cl. ..... 61/45 D

[58] Field of Search ..... 61/45 D; 299/31-33; 248/357; 91/170 MP; 403/324, 379

[56] References Cited

U.S. PATENT DOCUMENTS

| | | | |
|---|---|---|---|
| 353,218 | 11/1886 | Harrington | 403/324 X |
| 3,240,022 | 3/1966 | Mills et al. | 61/45 D |
| 3,312,071 | 4/1967 | Dommann | 61/45 D |
| 3,324,664 | 6/1967 | Allen | 61/45 D |
| 3,342,273 | 9/1967 | Crane | 403/379 X |
| 3,390,897 | 7/1968 | Moore | 403/379 X |
| 3,397,543 | 8/1968 | Spies et al. | 61/45 D |
| 3,408,820 | 11/1968 | Bower | 61/45 D |

FOREIGN PATENT DOCUMENTS

| | | | |
|---|---|---|---|
| 2,229,203 | 12/1972 | Germany | 61/45 D |
| 1,120,318 | 7/1968 | United Kingdom | 61/45 D |

*Primary Examiner*—Dennis L. Taylor

*Attorney, Agent, or Firm*—Lowe, King, Price & Markva

[57] ABSTRACT

A mine roof support comprises a plurality of hydraulically extensible chock legs attached at their upper ends to one or more elongate roof bars by means of a projection on each chock leg passing through an aperture in the underside of the roof bar(s) to be located in articulated manner in any one of a plurality of positions along the roof bar(s) and within the roof bar(s) by abutment means.

21 Claims, 6 Drawing Figures

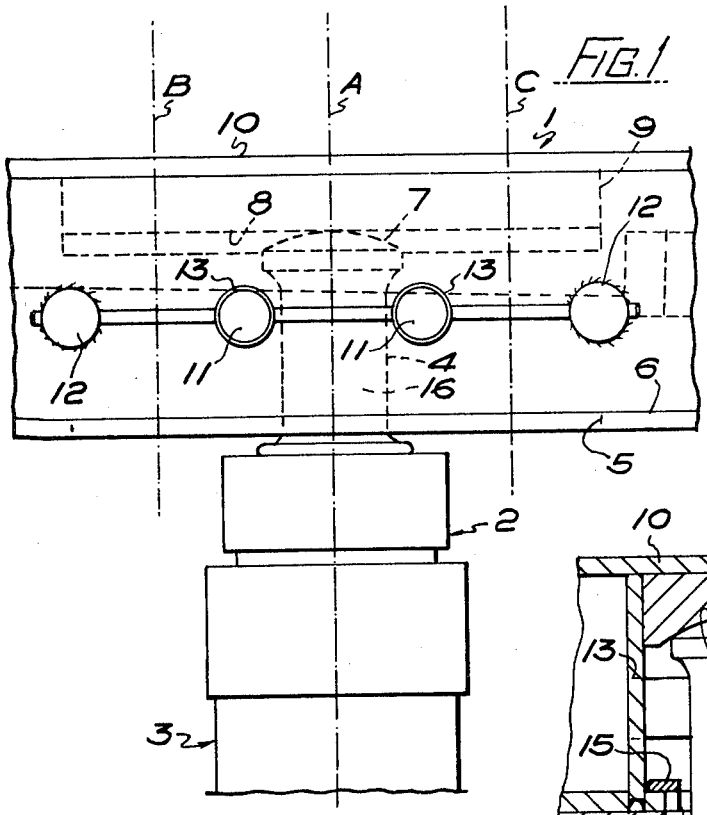
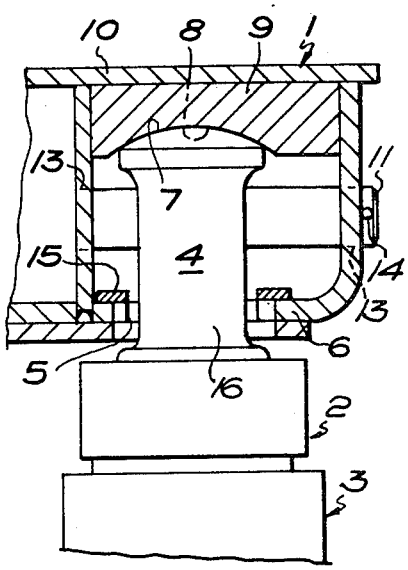
FIG. 3
FIG. 2
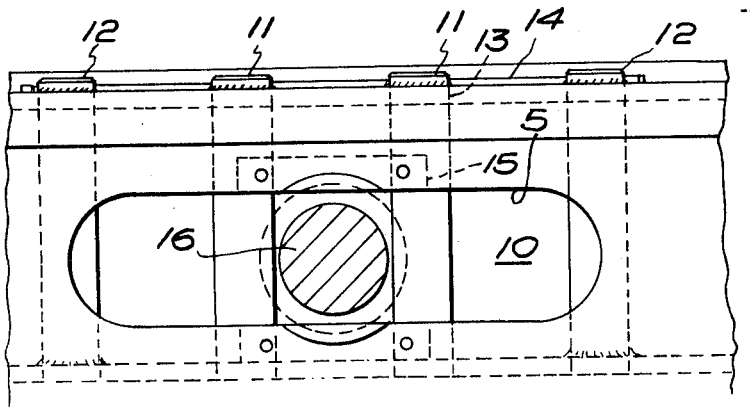

MINE ROOF SUPPORTS

This invention relates to hydraulically powered self-advancing mine roof supports as are commonly employed along a mineral face adjacent an armoured face conveyor.

Such supports have incorporated one or more roof bars attached to upper end of a plurality of chock legs, the lower ends thereof being seated on base means. Articulated connections are known between the roof bar(s) and the chock legs to accommodate displacement forces encountered in service, rather than the support being permanently damaged by such forces, but whatever connection has been employed in the past, the roof bar(s) has always had a fixed position of location on the chock legs.

Conventionally, a forward attachment of the roof bar(s) extends towards, and sometimes over, the face conveyor and associated mining machine to provide additional roof support in advance of the forward end of the roof bar(s). It is also known to provide roof bar(s) with either an advancable and retractable forepoling beam or to pivotally attach bellcrank type levers to the forward end of the roof bar(s). However, different conveyor/spill plate/mining machine combinations vary the overhand required by the roof bar (or any extension thereof) and in the past, forward attachments of roof bars have been constituted by extension pieces manually inserted into the roof bar, extension pieces of different lengths being required to accommodate the various extension distances required.

According to the present invention, a mine roof support comprises a plurality of hydraulically extensible chock legs attached at their upper ends to one or more elongate roof bars by means of a projection on each chock leg passing through an aperture in the underside of the roof bar(s) to be located in articulated manner in any one of a plurality of positions along the roof bar(s) and within the roof bar(s) by abutment means.

Thus the roof bar(s) may be secured in a first position with respect to the chock legs, to suit a first conveyor/spill plate/mining machine combination and be adjustable from this first position to suit a second combination and/or to advance or retract its roof supporting position. In detail, the abutment means may be removable, in which case positional adjustment of the roof bar(s) with respect to the chock legs, to advance or retract the roof bar(s) from a first position to the required second position, may be effected simply by sliding the roof bar(s) forwards or rearwards over the projection of the chock legs, without the need to remove it from the chock legs. Alternatively, the abutment means may be fixed so as to define a plurality of pockets into selected ones of which the upper ends of the chock legs are inserted, but this involves the lifting of the roof bar(s) over the chock legs to attain the new position.

The aperture in the underside of the roof bar(s) may each, for fixed abutment means, take the form of a rectangular or circular hole to provide access to a bearing pad, preferably having an arcuate bearing surface within the roof bar. For a removable abutment means, the apertures may each take the form of a slot, again to provide access to a bearing pad. The removable abutment means may comprise a pair of spaced apart, fixed abutment members e.g. pins and between these, a pair of removable abutment members e.g. pins located fore and aft of each chock leg projection with regard to the longitudinal axis of the roof bar(s). In a first embodiment, the removable pins may each be locatable only in one position, or in a second embodiment may each be locatable in one of two positions and co-operate with a plurality of displaceable blocks.

Preferably, each chock leg projection is mushroom headed to provide firstly a complementary arcuate bearing surface for a bearing pad and secondly, at the projection neck an articulated connection to the pins, if pins, or pins and blocks, having arcuate contact surfaces are provided as the abutment means. After passage of such projections through the apertures of the roof bar(s), accidental withdrawal of the projections (and consequent toppling of the roof bar(s) ), may be avoided by attaching a safety plate or safety pins adjacent each aperture of the roof bar(s). If plates, they themselves may each have an aperture of a smaller dimension than that of the head of the projection. If pins, they are located so as to define a smaller dimension that the head diameter. Preferably the projection is located on the piston part of each of the chock legs.

For removable abutment means in accordance with the first embodiment the roof bar(s) at the intended zone of connection between the upper end of a chock leg and the roof bar(s), may be provided at each zone with four sets of pin holes e.g. spaced 4 inches apart located along a common axis to provide four pin positions, the fixed pins being located in the outer holes and to define three projection positions i.e. a first position between one fixed pin and an adjacent removable pin, a second, middle position between the two removable pins (e.g. when the roof bar is advanced 4 inches), and a third position between the other fixed pin and its adjacent removable pin (e.g. when the roof bar is advanced a further 4 inches). This same mode of roof bar advancement may be repeated in accordance with a further embodiment in which no fixed pins are employed, but the roof bar(s) is provided with four holes into any adjacent pair of which a pair of removable pins may be inserted to embrace a projection of a chock leg.

Preferably, however, the combination of pins and blocks is employed as the removable abutment means. Thus for each chock leg projection, four sets of pin holes are provided into any of which, as required, the pair of removable pins are locatable, with the fixed pins, beyond the foremost and rearmost sets of pin holes, at the same pitch as the spacing between the pin holes e.g. 6 inches. Six mateable blocks are located in the roof bar for each chock leg projection, and are preferably slidable, yet captive, along the longitudinal axes of the roof bar. Each block perferably has an arcuate projection on one face and an arcuate recess on an opposite face, the projection being either to engage the periphery of a chock leg projection, or alternatively to mate with an adjacent block by entering the recess thereof, the curvature of the arcuate projections and recesses corresponding to that of the pins and pin holes. With the chock leg projection in a central position i.e. located between the second and third pin holes, three blocks are located to each side of the projection, the arcuate surface of the leading block being maintained in engagement with the periphery of the chock leg projection by the removable pins being inserted into the first and fourth holes. By suitably manouvering the pins and blocks, the latter having a 2 inch effective dimension in the longitudinal direction of the roof bar(s), the roof bar(s) can be advanced or retracted in 2 inch increments from the central position mentioned above.

To ensure retention of the pins, each may have a diametral hole at a free end projecting from the roof bar(s) for the passage of a securing device e.g. a dowel or there may be provided a latching device e.g. a wedge.

If it is required to suspend an anti-flushing shield on the rear end of the roof bar(s), a plurality of suspension positions may be provided to give the optimum anti-flusing shield location for any selected position of the roof bar. If the roof bar employes a forepoling beam that is hydraulically extendable and retractable with respect to the roof bar(s), the ram employed to displace the forepoling beam may also be employed to displace the roof bar to a new position.

The invention will now be described in greater detail, by way of examples, with reference to the accompanying drawings, in which:

FIG. 1 shows the position of the upper end of one chock leg and roof bar of a first embodiment of a four leg mine roof support in accordance with the invention;

FIG. 2 is a view in the direction of arrow B of FIG. 1;

FIG. 3 is a section of the line C—C of FIG. 2;

In both embodiments, like reference numerals are employed for like components.

Figure 4:
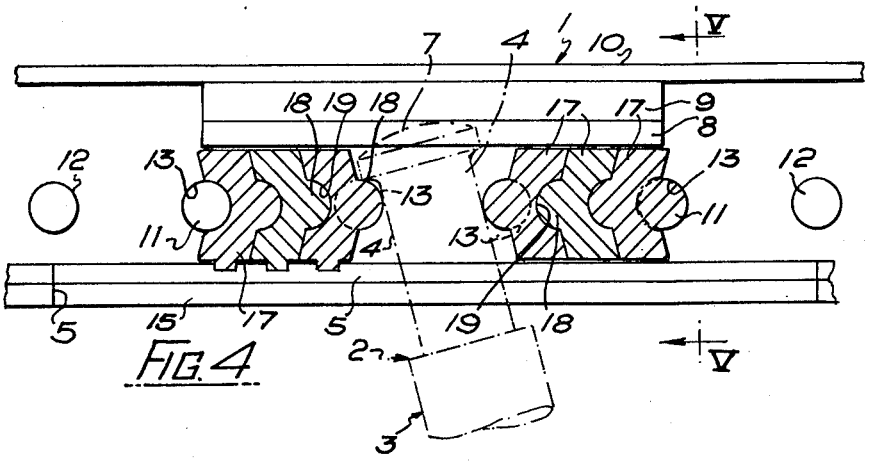
FIG. 4 shows to a larger scale the upper end of one chock leg and roof bar of a second embodiment of mine roof support in accordance with the invention.

In the drawings an elongate roof bar 1 is mounted on upper ends 2 of a plurality of hydraulically extensible chock legs 3 (only one of a pair of forward legs being indicated in the drawings) of a self-advancing hydraulically actuated mine roof support. Each chock leg 3 terminates in a mushroom headed projection 4 which passes through an aperture constituted by a slot 5 in a bottom plate 6 of the underside of the roof bar 1, the projection 4 having a convex bearing surface 7 to contact a complementary surface 8 of a bearing pad 9 located within the roof bar 1 and attached to a top plate 10 thereof.

In the embodiment of FIGS. 1 to 3, abutment means is constituted by two removable pins 11, and two fixed pins 12, the pins 11 being insertable into and removable from two sets of pin holes 13 such that the axes of pins 12 and inserted pins 11 are equally spaced in the longitudinal direction of the roof bar 1. As shown in FIG. 1, this enables the longitudinal axis of the chock legs 3 to be at a mid position A while alternative position B and C are possible by removing the appropriate pins 11, at all the chock legs 3 and sliding the roof bar 1 forwards or rearwards, as required. The removable pins 11 may be retained by a securing dowel rod 14, while unintentional withdrawal of the projections 4 from their slots 5 is avoided by providing a displaceable retainer of safety plate 15 having an aperture smaller than that of the mushroom head of the projection 4, but larger than neck 16 thereof.

Figure 5:
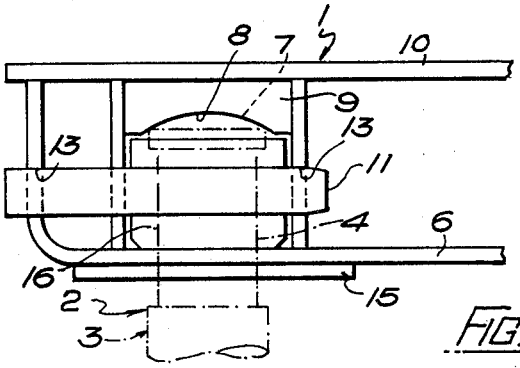
FIG. 5 is a view on the line V—V of FIG. 4.
Figure 6:
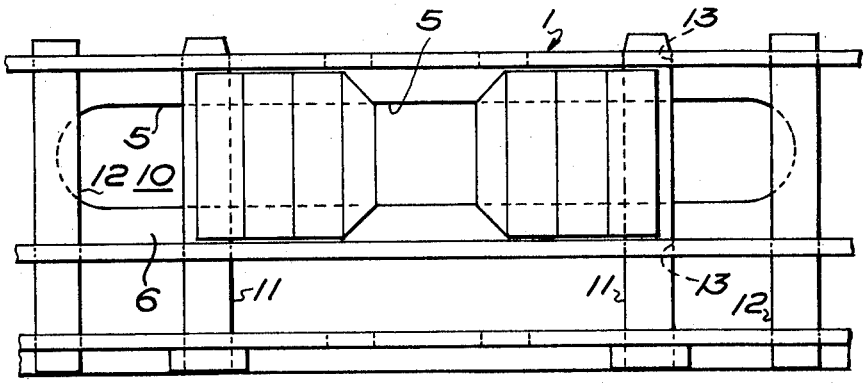
FIG. 6 is an underneath plan view of FIG. 4.

In the embodiment of FIGS. 4 to 6, the abutment means comprises two fixed pins 12, two removable pins 11 insertable into any two of four sets of pin holes 13, and six mating blocks 17 each having an arcuate projection 18 and an arcuate recess 19, the blocks being removable from and slidable along the roof bar 1. As shown in FIG. 4, with the pins 11 inserted into the sets of outer holes 13, three blocks 17 are located to each side of the projection to locate the chock legs 3 at the mid-position A. By giving each block 17 an effective dimension of 2 inches in the longitudinal direction of the roof beam, removal and repositioning of pins and blocks e.g. so that two blocks 17 are to one side of the projections 4 and four blocks 17 are to the other side or projections 4, displacement of the roof bar 1 on the chock legs 3 is possible by increments of 2 inches, and again displacement is by sliding the roof bar 1 over the projections 4.

What we claim is:

1. A mine roof support comprising a hydraulically extensible chock leg, an elongated roof bar supported by the upper end of said leg, means for attaching said upper end to said bar including a projection on said upper end of said leg, and abutment means defining a plurality of apertures along the underside of the roof bar, said projection to be adjustably located in an articulated manner in any one of said plurality of apertures, said abutment means being positioned to define said apertures and retain said projection.

2. A mine roof support as claimed in claim 1, wherein said abutment means is removable.

3. A mine roof support as claimed in claim 1, wherein said abutment means is fixed.

4. A mine roof support as claimed in claim 3, wherein is provided a bearing pad in said roof bar engaging said projection, and said fixed abutment means comprises a hole in said roof bar, said hole providing access to said bearing pad within the roof bar.

5. A mine roof support as claimed in claim 4, wherein said bearing pad has an arcuate bearing surface.

6. A mine roof support as claimed in claim 1, wherein the apertures each take the form of a slot.

7. A mine roof support as claimed in claim 2 wherein the removable abutment means comprises a pair of spaced apart, fixed abutment members and between these, a pair of removable abutment members, all of said members extending transversely with regard to the axis of the roof bar.

8. A mine roof support as claimed in claim 7, wherein the fixed abutment members include pins.

9. A mine roof support as claimed in claim 8, wherein the removable abutment members include pins.

10. A mine roof support as claimed in claim 9, wherein the removable pins are each locatable only in one position.

11. A mine roof support as claimed in claim 9, wherein the removable pins are each locatable in one of two positions and a plurality of displaceable blocks cooperating with said pins to form the abutment means.

12. A mine roof support as claimed in claim 1, wherein said projection is mushroom headed.

13. A mine roof support as claimed in claim 12, wherein is further provided retainer means adjacent said apertures of the roof bar to prevent accidental withdrawal of the projection.

14. A mine roof support as claimed in claim 13, wherein said retainer means comprises a safety plate having an aperture of a smaller dimension than that of the head of the projection.

15. A mine roof support as claimed in claim 12, wherein said abutment means comprises at least two adjacent pins, the spacing between the pins defining a smaller dimension than that of the head diameter to prevent accidental withdrawal of the projection.

16. A mine roof support as claimed in claim 1, wherein the projection is located on the piston part of said leg.

17. A mine roof support as claimed in claim 10, wherein roof bar(s) at the intended zone of connection between the upper end of a chock leg and the roof bar(s) are provided at each zone said abutment means includes four sets of pin holes spaced apart, each set located along a common axis to provide four pin positions, said fixed pins being located in the outer sets, said pins mounted in said four positions defining three projection retaining positions.

18. A mine roof support as claimed in claim 17 wherein is provided a pair of said removable pins located in the inner sets of pin holes to embrace said projection.

19. A mine roof support as claimed in claim 18 wherein is provided mateable spacer blocks being located in the roof bar, said blocks forming said abutment means by engagement with said pins, said blocks being slidable along the longitudinal axes of the roof bar for adjustment, and means to hold said blocks captive within said bar during use.

20. A mine roof support as claimed in claim 19, wherein each block has an arcuate projection on one face and an arcuate recess on an opposite face, the arcuate projection engaging the periphery of a chock leg projection and adapted to mate with an adjacent block by entering the recess thereof, the cruvature of the arcuate projections and recesses corresponding to that of said pins.

21. A mine roof support as claimed in claim 9, wherein each pin has a diametral hole at a free end projecting from the roof bar for the passage of a securing rod.

* * * * *